US009808839B2

(12) United States Patent
Liu et al.

(10) Patent No.: US 9,808,839 B2
(45) Date of Patent: Nov. 7, 2017

(54) PRESSURE WASHER WITH HOSE REEL AND MOTOR PUMP ASSEMBLY

(71) Applicant: Active Products Inc., North York (CA)

(72) Inventors: Ming Liu, North York (CA); John Schmider, Etobicoke (CA); Jonathan Loudon, Toronto (CA); Heather Lam, Toronto (CA)

(73) Assignee: Active Products Inc., North York (CA)

( * ) Notice: Subject to any disclaimer, the term of this patent is extended or adjusted under 35 U.S.C. 154(b) by 580 days.

(21) Appl. No.: 13/906,639

(22) Filed: May 31, 2013

(65) Prior Publication Data

US 2014/0352808 A1 Dec. 4, 2014

(51) Int. Cl.

| | |
|---|---|
| ***B08B 3/02*** | (2006.01) |
| ***F04D 29/62*** | (2006.01) |
| ***B05B 9/04*** | (2006.01) |
| ***B65H 75/42*** | (2006.01) |
| ***B65H 75/40*** | (2006.01) |
| ***B65H 75/44*** | (2006.01) |

(52) U.S. Cl.

CPC ..... *B08B 3/026* (2013.01); *B05B 9/0416* (2013.01); *B65H 75/403* (2013.01); *B65H 75/42* (2013.01); *B65H 75/4478* (2013.01); *B65H 75/4494* (2013.01); *F04D 29/628* (2013.01); *B08B 2203/0276* (2013.01); *Y10T 137/6918* (2015.04); *Y10T 137/6958* (2015.04); *Y10T 137/85978* (2015.04)

(58) Field of Classification Search

CPC ..... B05B 9/0416; B08B 3/026; B08B 2203/0247; B08B 2203/0276; Y10T 137/86268; Y10T 137/8807; Y10T 137/6918; F04D 5/00; F04D 29/628; B65H 75/4478

USPC ..... 417/502, 519; 415/126, 127, 206, 203

See application file for complete search history.

(56) References Cited

U.S. PATENT DOCUMENTS

| | | | | |
|---|---|---|---|---|
| 2,396,083 | A * | 3/1946 | Chase | F04D 29/445 415/112 |
| 2,490,305 | A | 12/1949 | Jones | |
| 2,772,636 | A * | 12/1956 | Yates | F04D 29/406 415/127 |
| 3,306,213 | A | 2/1967 | Fritz | |
| 4,810,169 | A | 3/1989 | Kranzle | |
| 4,848,659 | A * | 7/1989 | Tadych | 239/127 |
| 4,865,255 | A * | 9/1989 | Luvisotto | 239/149 |
| 6,439,475 | B1 | 8/2002 | Kloepfer | |
| 7,156,614 | B2 * | 1/2007 | Racer | F04D 7/04 415/116 |
| 7,210,902 | B2 * | 5/2007 | Song et al | 415/202 |

(Continued)

FOREIGN PATENT DOCUMENTS

| | | | |
|---|---|---|---|
| CA | 447512 | A | 3/1948 |
| DE | 4119907 | A1 | 12/1992 |

(Continued)

*Primary Examiner* — Kevin Murphy

(74) *Attorney, Agent, or Firm* — Bhole IP Law; Anil Bhole

(57) ABSTRACT

A pressure assisted washer or pressure washer with hose reel and motor pump assembly. The hose reel defines a bore in which a motor pump assembly is disposed. The hose reel comprises a cylinder having an aperture through which pressurized fluid can be accessed through a coupling in fluid communication with a pump. The pump has a rotating collar.

12 Claims, 15 Drawing Sheets

(56) References Cited

U.S. PATENT DOCUMENTS

| | | | | |
|---|---|---|---|---|
| 2008/0179879 | A1* | 7/2008 | Wu | 285/148.1 |
| 2010/0178185 | A1* | 7/2010 | Leu et al. | 417/572 |
| 2010/0232990 | A1* | 9/2010 | Marioni | 417/410.1 |
| 2012/0006431 | A1* | 1/2012 | Gilpatrick | 137/565.01 |

FOREIGN PATENT DOCUMENTS

| | | | |
|---|---|---|---|
| EP | 0438680 | A2 | 7/1991 |
| WO | WO9961176 | A1 | 12/1999 |
| WO | WO0139900 | A1 | 6/2001 |
| WO | WO2004069436 | A1 | 8/2004 |

* cited by examiner

PRESSURE WASHER WITH HOSE REEL AND MOTOR PUMP ASSEMBLY

TECHNICAL FIELD

The following relates to a pressure washer and more particularly to a pressure washer having a hose reel and a motor pump assembly disposed within the hose reel.

BACKGROUND

Hose reels are generally used for convenient and orderly storage of a garden hose. Generally, hose reels are either fixed to a part of the home or other fixed structure on the property or are transportable by the use of wheels or the like. Typically, the hose expels water at a pressure suitable for gardening. However, users typically try to use the hose to wash the sides of their houses or other outdoor structures.

In order to perform such tasks, it is desirable for the hose to be equipped with a pump to boost the pressure of the water stream to provide improved spraying distance and/or cleaning power, effectively turning the hose reel into a pressure assisted washer. However, pressure washers are sometimes heavy and unstable, such that they may tip or fall over during use as they tend to be top-heavy.

SUMMARY

In one aspect, a pressure assisted washer is provided, said pressure assisted washer comprising: (a) a fluid inlet for receiving fluid; (b) a motor pump assembly comprising a motor, a pump in fluid communication with said fluid inlet, and a rotary coupling, said rotary coupling in fluid communication with an outlet of said pump, said motor pump assembly operable to pressurize said fluid and output pressurized fluid to said rotary coupling, said motor pump assembly having opposing side hubs defining a central axis, the rotary coupling rotatable about said central axis; (c) a frame comprising two side walls joined by said motor pump assembly and permitting access to said fluid inlet for receiving fluid; (d) a hose reel comprising a cylinder having a central bore and opposing circular side walls at ends of said bore, said hose reel being rotatable about said central axis, said cylinder having an aperture therethrough; and (e) a hose-reel connector disposed through said aperture in fluid communication with said rotary coupling.

In another aspect, a fluid pump having a rotary fluid outlet is provided, the fluid pump comprising: (a) a pump body having a cylindrical outer surface and an inner cylindrical bore; (b) a fluid inlet disposed at a first end of said bore, said fluid inlet permitting fluid to be provided to said fluid pump; (c) a fluid outlet, said fluid outlet being an arcuate aperture extending along a portion of a surface of said bore; (d) an impeller disposed at a second end of said bore such that said fluid outlet is disposed between said fluid inlet and said impeller, said impeller operable to pressurize said provided fluid and expel said pressurized fluid to said fluid outlet; and (e) a collar rotatably coupled to and encircling at least a portion of the length of said outer surface and completely surrounding said fluid outlet, said collar forming a cavity along said pump body and having a collar outlet, said collar outlet maintaining fluid communication with said fluid outlet.

BRIEF DESCRIPTION OF THE DRAWINGS

The features of the invention will become more apparent in the following detailed description in which reference is made to the appended drawings wherein.

DETAILED DESCRIPTION

Figure 1:
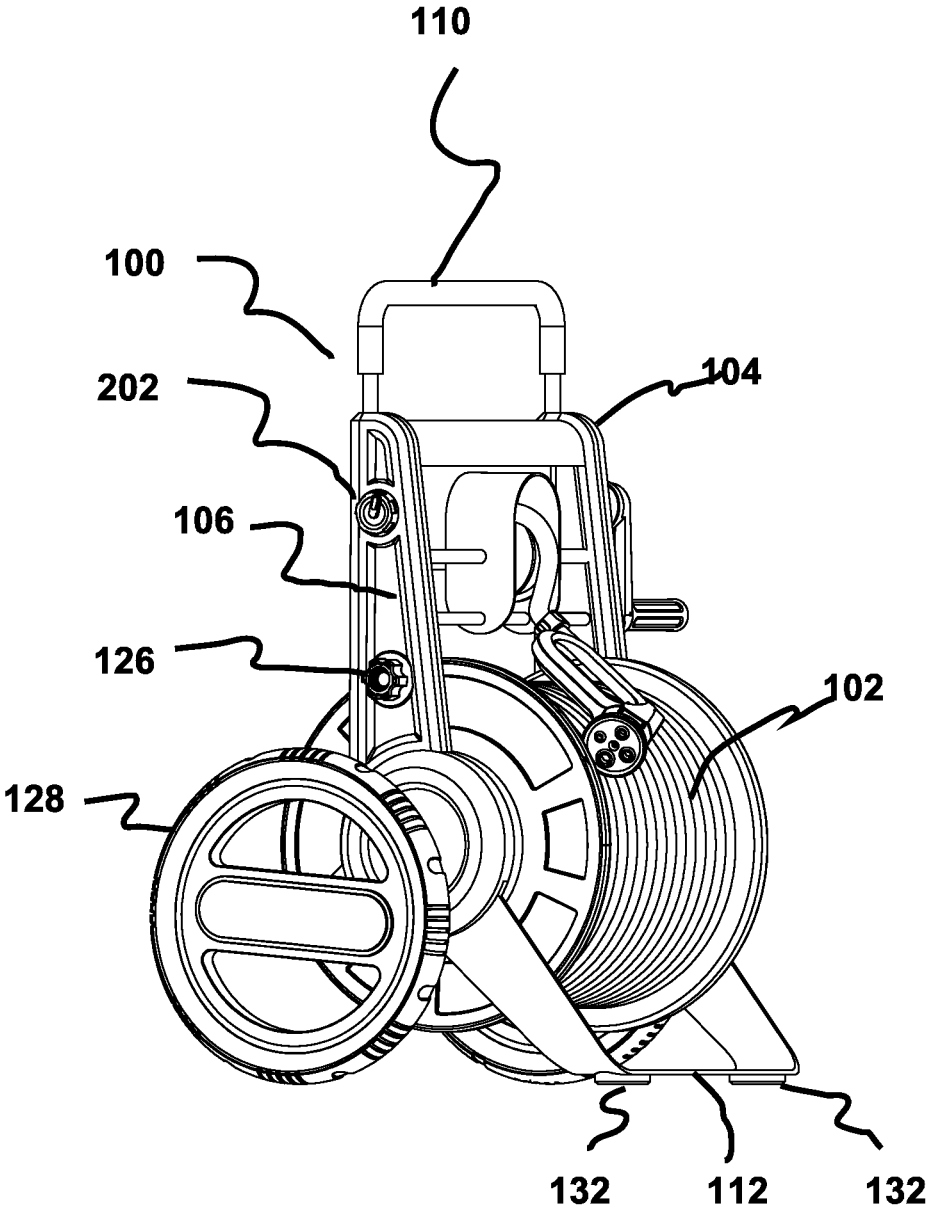
FIG. 1 is a front left perspective view of an embodiment of a pressure washer.

Embodiments will now be described with reference to the figures. It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

The following provides a pressure assisted washer (hereinafter "pressure washer") with hose reel and motor pump assembly. The pressure washer may be equipped with or coupled to a hose that could be a high-pressure hose or a typical garden hose. By providing pressurization, the capable length of the garden hose may be increased, for example to 50' or more.

The hose reel defines a bore in which a motor pump assembly is disposed so as to provide a low centre of gravity and isolation of the motor pump assembly. The hose reel comprises a cylinder having an aperture through which pressurized fluid can be accessed through a coupling in fluid communication with a pump having a rotating collar coupled thereto.

It will be appreciated that the following pressure washer could alternatively be used as a pumping apparatus wherein fluid is input from a fluid reservoir and pumped to a desired location. It will further be appreciated that the pump with rotating collar described herein is not limited in application to a pressure washer.

Figure 2:
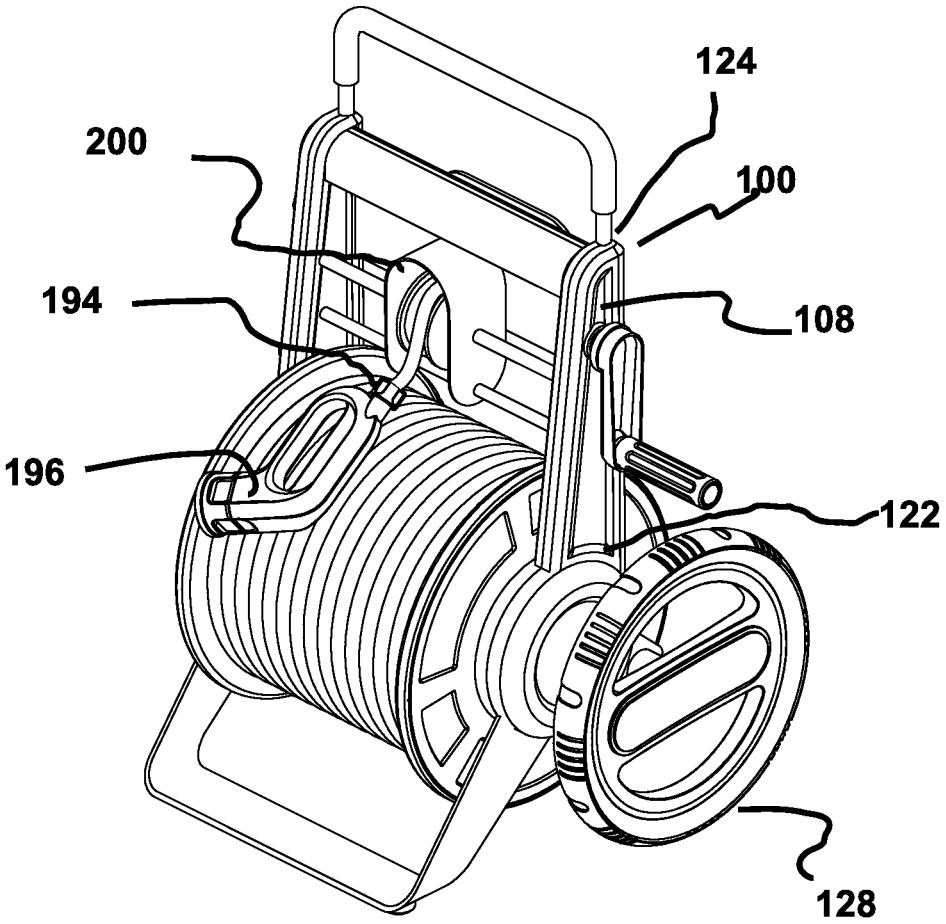
FIG. 2 is a front right perspective view of the pressure washer.
Figure 3:
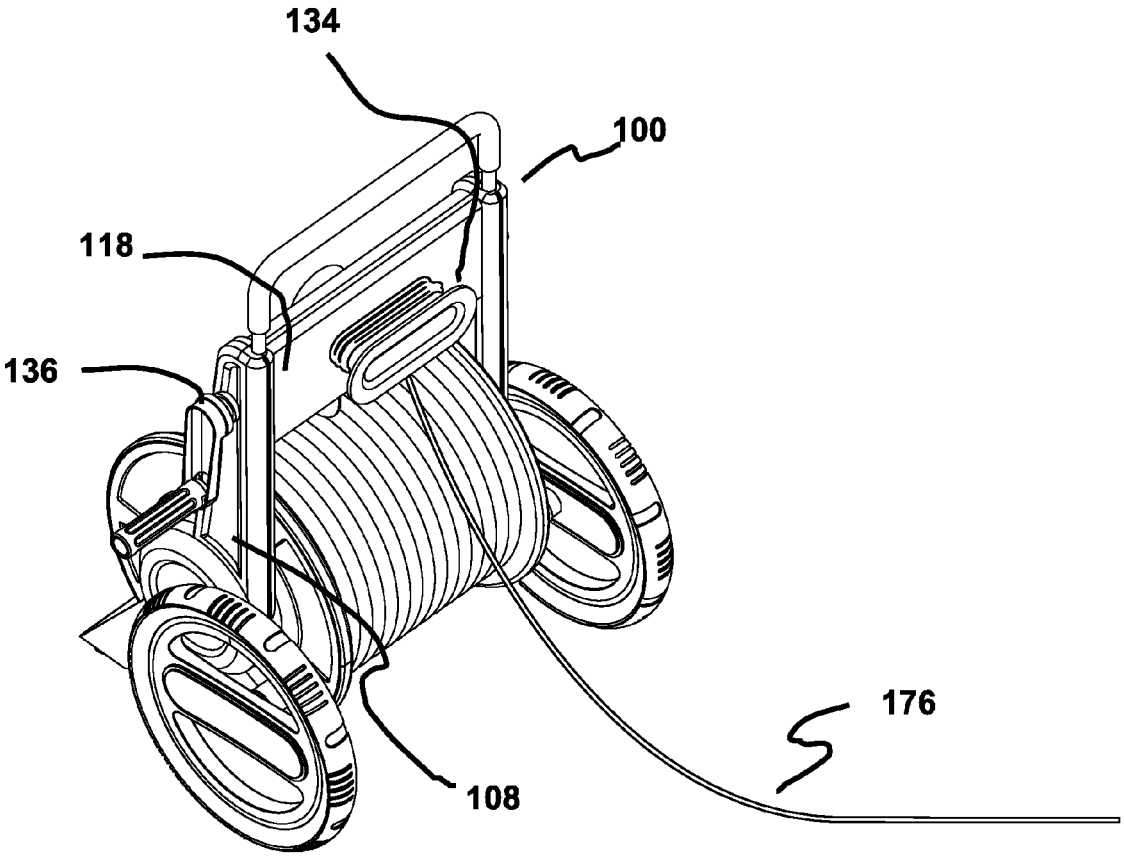
FIG. 3 is a rear perspective view of the pressure washer.
Figure 4:
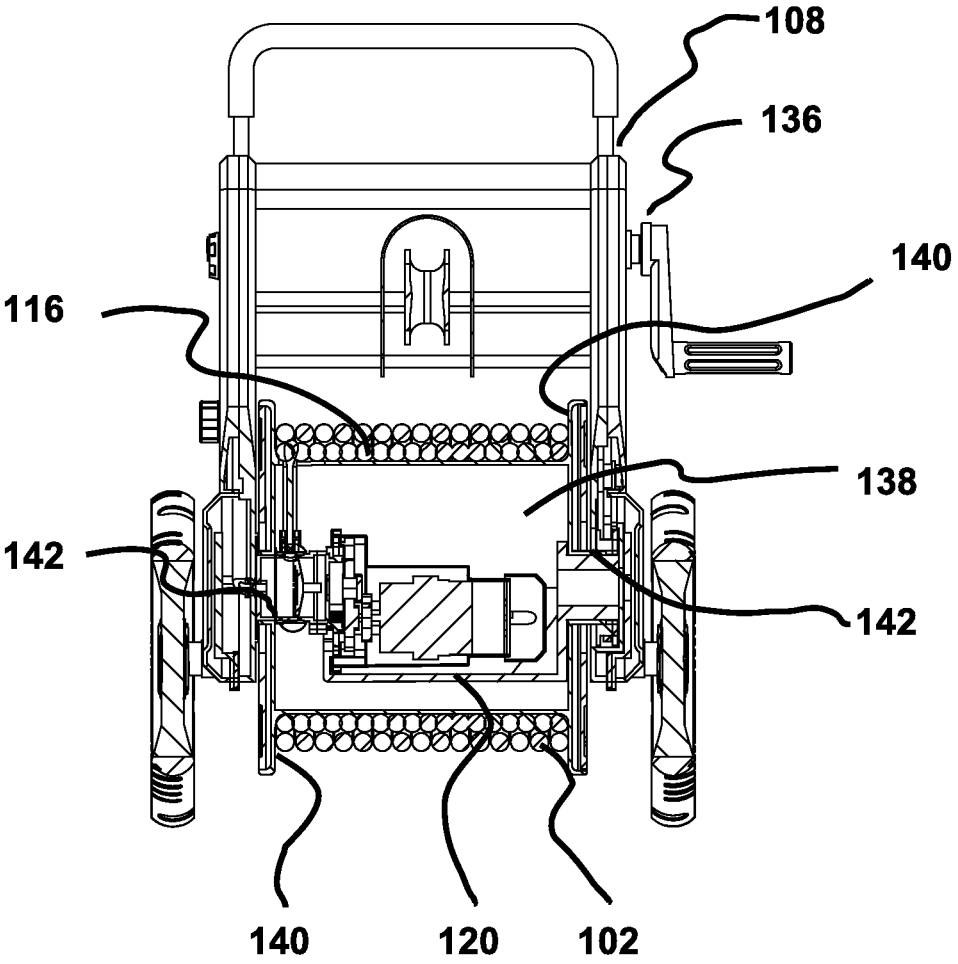
FIG. 4 is a front cross-sectional view of the pressure washer taken along the line A-A shown in FIG. 11.

Referring first to FIGS. 1, 2 and 3, perspective views of an embodiment of the pressure washer (100) show a hose (102) reeled thereupon. The pressure washer shown comprises a frame (104) having two opposing side walls (106, 108) connected by an upper crossbar (110), a lower crossbar (112), a motor pump assembly (120, FIG. 4), a fairlead (200) and a cord reel panel (118). Referring to FIG. 4, a hose reel (114) comprises a cylinder (116) surrounding the motor pump assembly (120) and is rotatable about a central axis defined by the motor pump assembly (120). The fairlead (200) may be disposed between the hose reel (114) and the upper crossbar (110), and the cord reel panel (118) may be disposed behind the fairlead (200).

Referring again to FIGS. 1, 2 and 3, the side walls (106, 108) are substantially triangular with the base (122) of the side walls (106, 108) being wider than the apex (124) of the side walls (106, 108). A fluid inlet coupling (126) is disposed along one of the side walls (106). As shown, the fluid inlet coupling (126) is offset above the central axis of the hose reel (114).

A pair of coaxial rear wheels (128) extends from the side walls (106, 108). In use, the frame (104) is supported by the pair of wheels (128) and lower crossbar (112). The upper crossbar (110) serves as a handle. The wheels (128) may be located at approximately the left and right extents of the frame (104) to maximize stability. A user can transport the pressure washer (100) by tilting the pressure washer along the wheels' axis to raise the lower crossbar (112) from the ground, and subsequently rolling the pressure washer (100) to a desired location. In alternative embodiments, the rear wheels (128) may be dispensed with, resulting in a less easily transportable pressure washer, or could be a single or plurality of wheels. In the embodiment shown, the wheels are larger than is typical for a pressure washer, such as over 14", though any suitable size will work.

Figure 5:
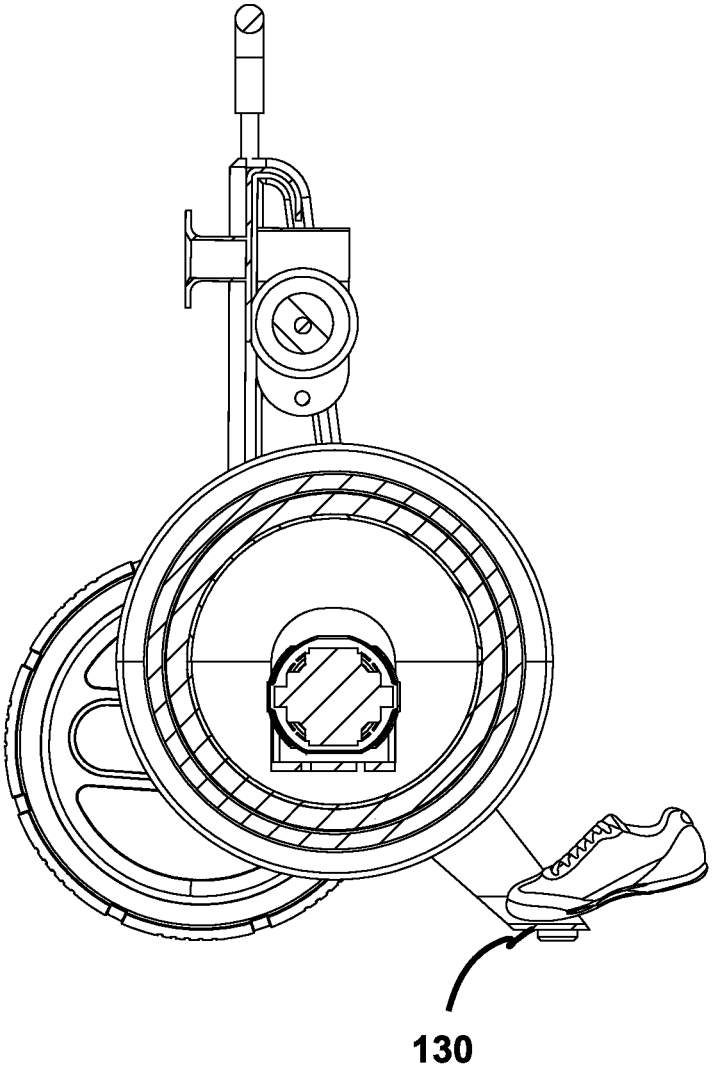
FIG. 5 is a right side cross-sectional view of the pressure washer taken along the line D-D shown in FIG. 14.
Figure 6:
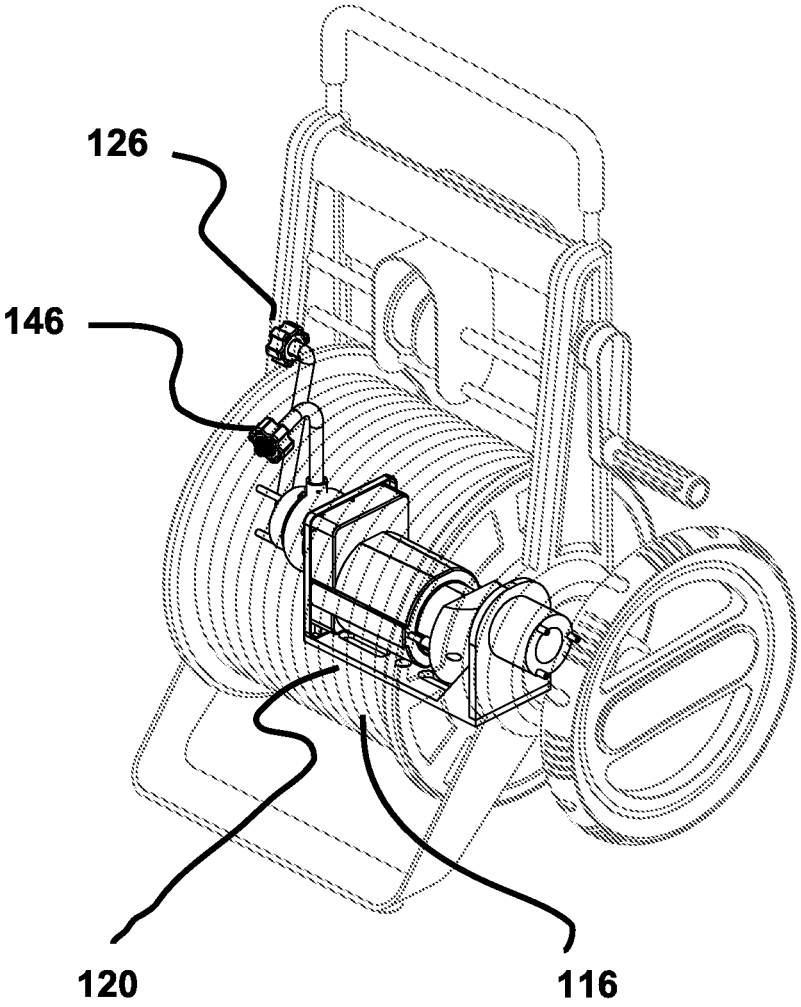
FIG. 6 is a front right perspective view of the pressure washer showing the motor pump assembly disposed within the hose reel.
Figure 7:
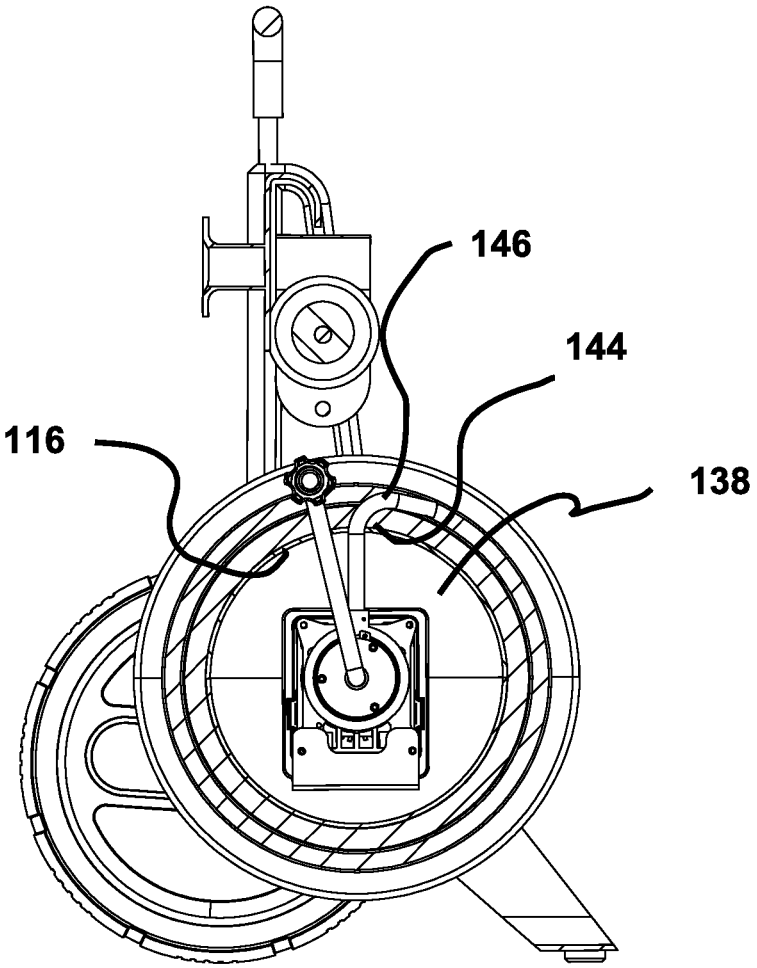
FIG. 7 is a left side cross-sectional view taken along the line B-B shown in FIG. 12.
Figure 8:
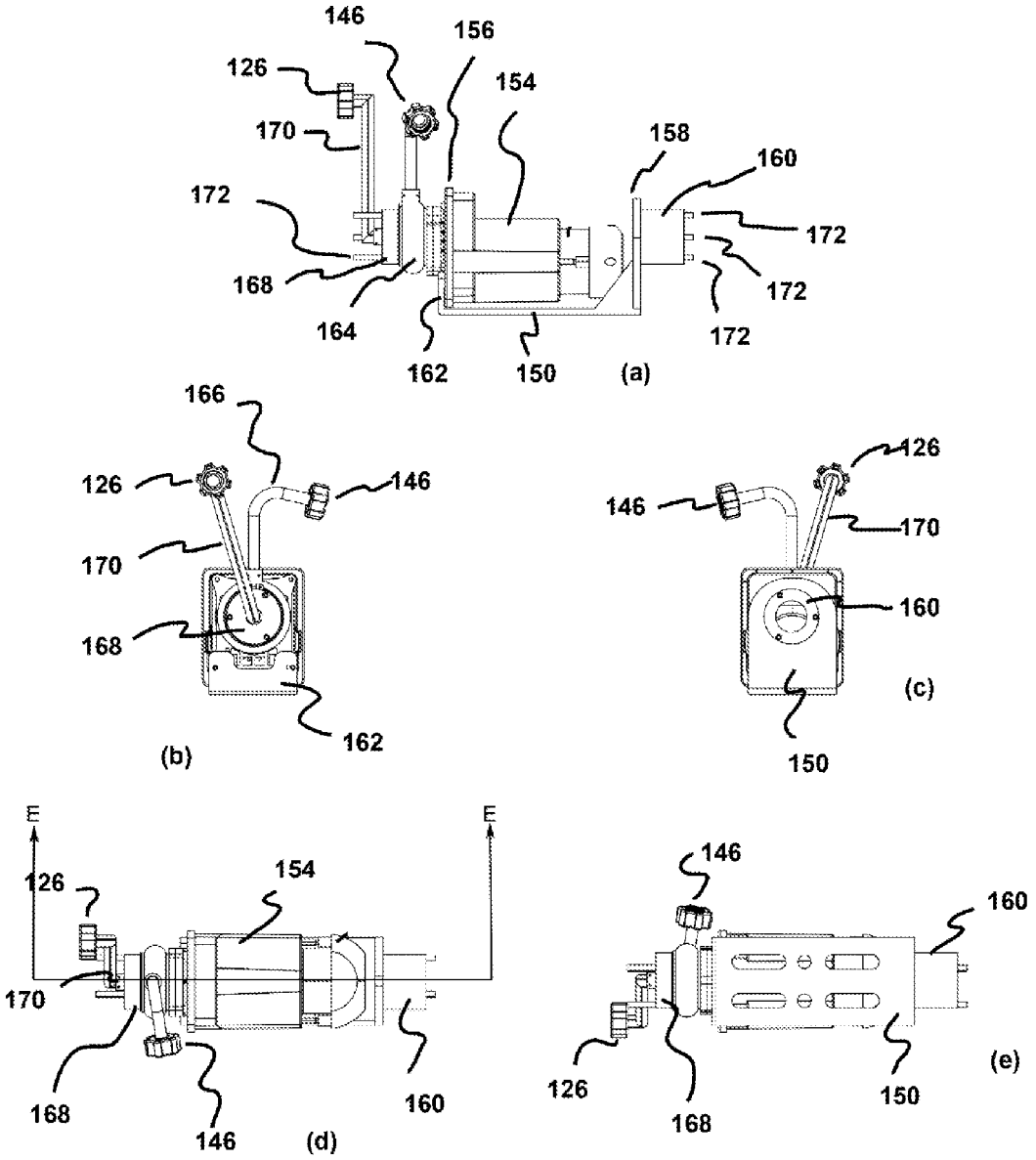
FIG. 8 is an isolated view of the motor pump assembly and fluid inlet.

The lower crossbar (112) may alternatively be replaced by wheels, providing a four-wheeled pressure washer, or by a plurality of legs. The lower crossbar (112) may comprise a substantially flat upper surface (130), providing a convenient location for a user to rest her foot to prevent movement of the pressure washer while reeling or unreeling the hose, as shown in FIG. 5. As shown, the lower crossbar (112) may further have a plurality of resting pads (132) having disposed along its bottom surface for additional frictional engagement with the ground. The resting pads (132) are preferably compressible and have a bottom surface providing such frictional engagement.

Referring again to FIGS. 1 and 2, the upper crossbar (110) extends from one side wall (106) to the other side wall (108). However, the upper crossbar (110) may alternatively be replaced by left and right handles, each extending from one or the other of the side walls (106, 108). Optionally, handles could be dispensed with altogether provided that the frame (104) is grippable by a user in such a way as to enable the user to transport the pressure washer (100). In embodiments, the upper crossbar is elongated at its ends to enable the upper crossbar to be slidably engaged to the frame such that it can be extended and retracted substantially vertically from the frame.

Referring again to FIG. 3, the cord reel (134) is disposed along the rear surface of the cord reel panel (118). The cord reel (134) enables a user to wind and store an electrical cord (176) which powers the motor (154). The cord reel (134) shown is oblong and of sufficient width to allow the cord to be fully wrapped without becoming bulky (i.e., without requiring the user to loop the cord an unreasonable high number of loops).

A crank (136) is disposed upon one of the side walls (108). The crank (136) may be disposed proximate the handle (110) end of the frame (104) so that it is more comfortably accessible by a user. More specifically, the crank (136) may be disposed at a distance suitable for use by a user with minimal discomfort, such as approximately waist to elbow height of a typical user.

As can be seen throughout the figures, the hose reel (114) is disposed relatively low to the ground; that is, with its central axis closer to the lower crossbar (112) than to the upper crossbar (110). In embodiments, hose reel (114) has minimal ground clearance when the pressure washer rests on the wheels (128) and lower crossbar (112). As will be appreciated, the hose reel (114), hose (102), and motor pump assembly (120) are likely to comprise the majority of the weight of the pressure washer and, therefore, having the hose reel (114) substantially low to the ground enables the pressure washer (100) to have a low centre of gravity.

Referring to FIGS. 4, 6, 7 and 8, the hose reel (114), hose (102) and motor pump assembly (116) can be seen. The hose reel (114) comprises a cylinder (116) defining a central bore (138) and opposing circular side walls (140) at the ends of the bore (138) each having a diameter substantially larger than the bore (138). The larger side walls form boundaries to maintain the hose (102) on the hose reel (114) when reeled. Each of the side walls (140) has a central aperture (142).

The surface of the cylinder (116) has an aperture (144) through which a hose-reel coupling (146) is disposed. The hose-reel coupling (146) enables a connection between the hose (102) reeled on the hose reel (114) and the motor pump assembly (120) disposed within the central bore (138) of the hose reel (114).

The motor pump assembly (120) comprises a load bearing portion comprising a pump body (168) and a motor cradle (150). The motor cradle (150) comprises a mounting surface between opposing vertical walls (160, 162). A motor (154) and integral or coupled gearbox (155) are mounted to the motor cradle (150) above its mounting surface between the two walls. Alternatively, if the motor (154) is of sufficient load-bearing capability, the motor (154) may serve the function of the motor cradle (150).

The motor (154) is electrically driven by electricity obtained via the electrical cord (176) to rotate a shaft (not shown) that in turn drives the gearbox (155). The gearbox (155) is mounted to and operatively coupled with the pump body (168) to drive the pump. The pump body (168) and gearbox (155) are mounted to one another in line with vertical wall (162). The other vertical wall (160) extends vertically at the end of the motor opposing its shaft end. A first hub (160) extends horizontally along the outer surface of the vertical wall (160) (that is, the surface opposite to the motor). The first hub (160) is coaxial with the pump body (168), which acts as a second hub, and is load bearing.

The opposing first hub (160) and pump body (168) are circular and have a diameter slightly less than the diameter of the central apertures (142) of the hose reel side walls. Note that while the apertures (142) are shown to be of the same diameter, they need not be so, provided that each of the first hub (160) and pump body (168) is of a diameter suitable for its mating aperture (142). Each of the first hub (160) and pump body (168) may be fastened to a frame (104) side wall (106, 108), for example using bolts (172). In the embodiment shown, three bolts (172) are integral with each of the first hub (160) and pump body (168) and extend through mating apertures (not shown) of the frame side wall. Nuts (not shown) may be threaded to the bolts (160, 168) to affix the first hub (160) and pump body (168) to the side walls (106, 108).

The central apertures (142) of the hose reel (114) side walls (140) rest freely upon the first hub (160) and pump body (168) and, as the central apertures (142) have a diameter slightly greater than the first hub (160) and pump body (168), are thus rotatable about the first hub (160) and pump body (168).

Figure 13:
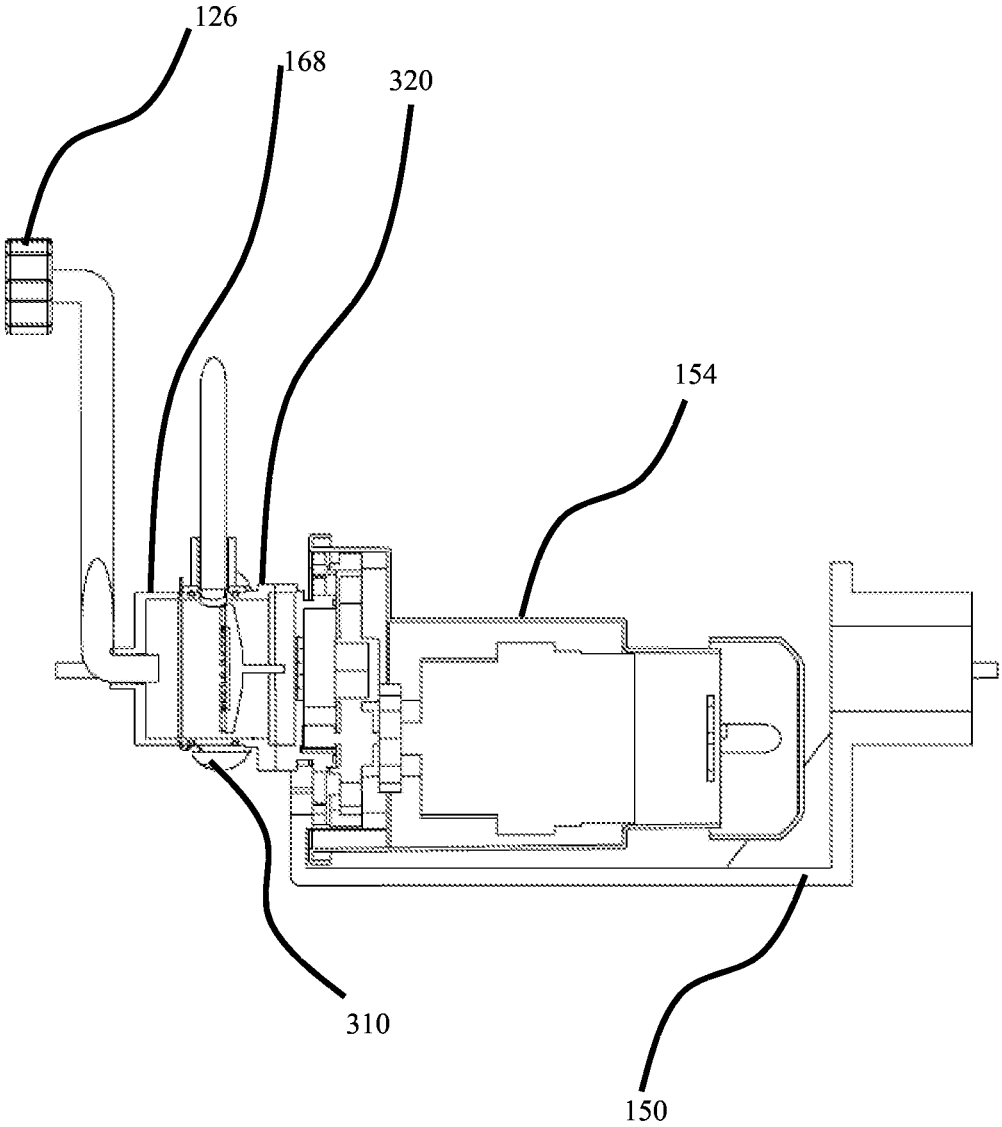
FIG. 13 is a cross sectional isolated front view of the motor pump assembly taken along the lines E-E shown in FIG. 8.
Figure 14:
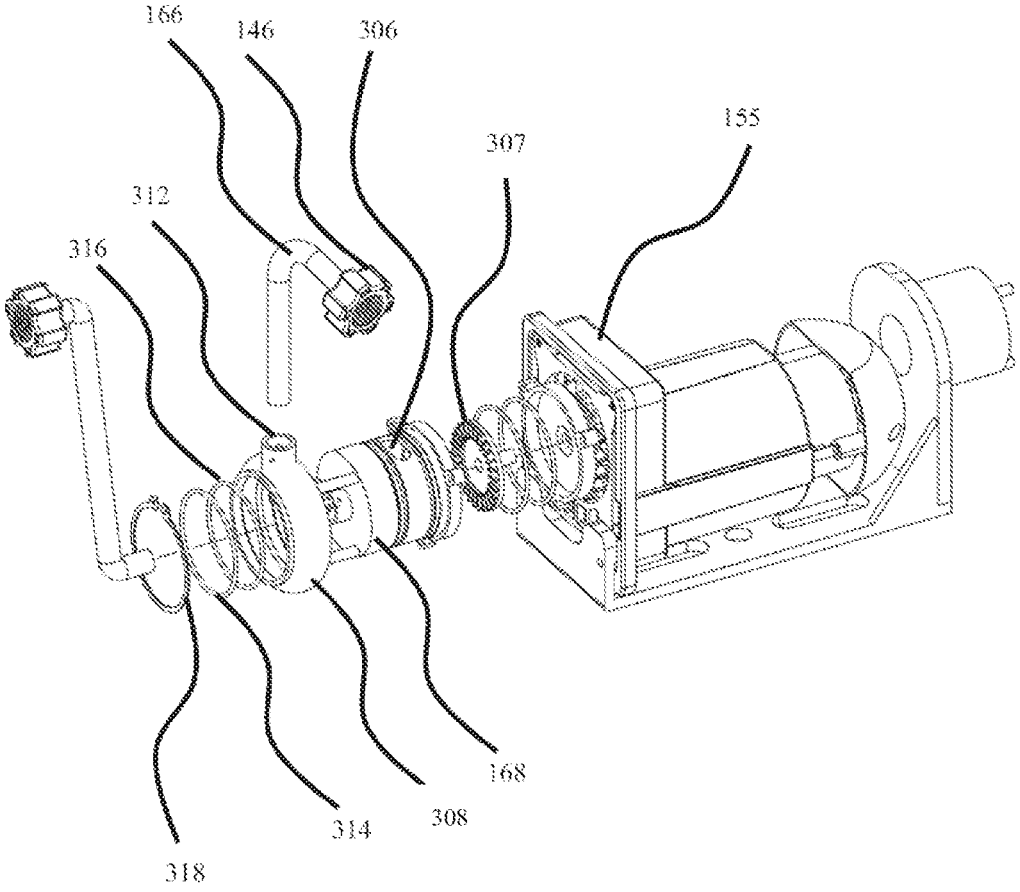
FIG. 14 an exploded perspective view of the motor pump assembly.
Figure 15:
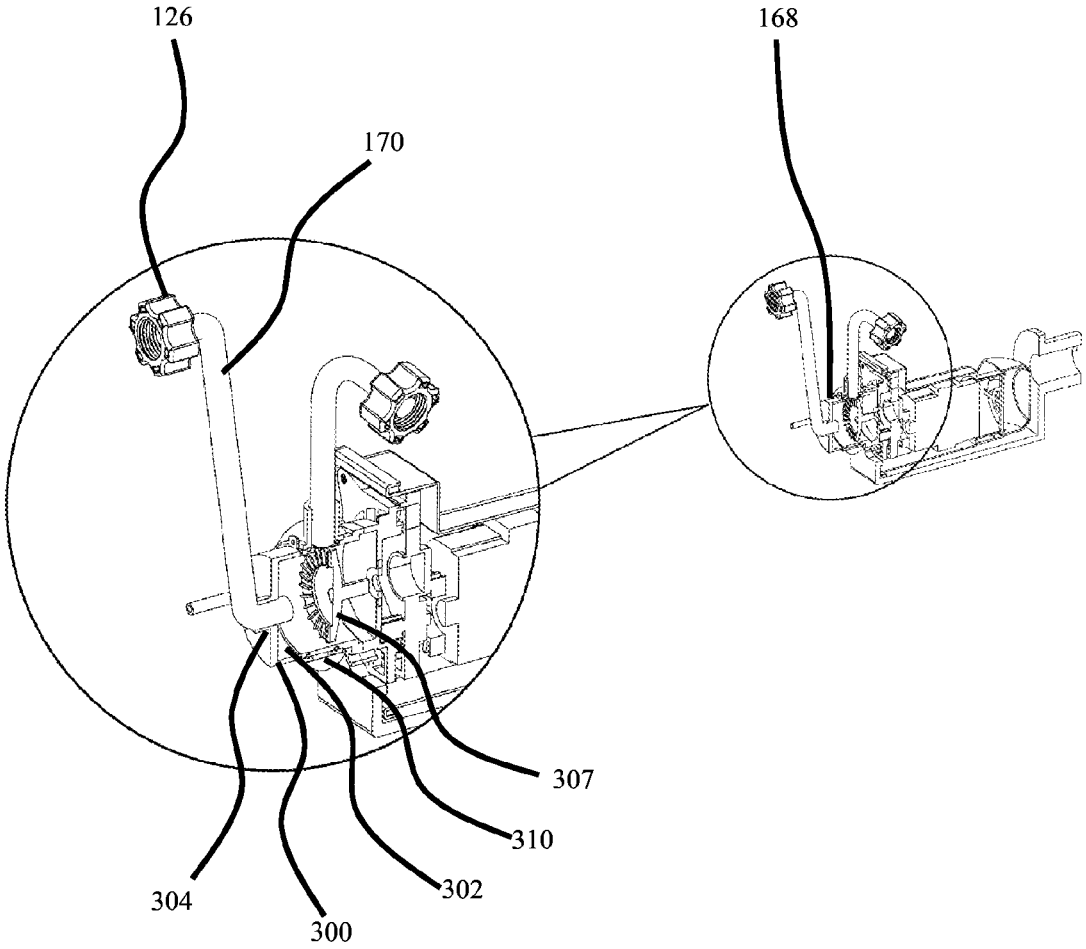
FIG. 15 is a cross sectional perspective view of the motor pump assembly taken along the lines E-E shown in FIG. 8.

Referring now to FIGS. 13, 14 and 15, more detailed views of the motor pump assembly are shown. The pump body (168) has a cylindrical outer surface (300) and defines a cylindrical inner bore (302) having a fluid inlet (304) in fluid communication with the inlet coupling (126), for example via hose connector (170). The inlet coupling (126) may be selected, for example, to mate to a common garden hose. The fluid inlet (304) is disposed along the side of the pump body (168) that extends beyond the hose reel such that the inlet tube (306) may be fixedly coupled to the pump body (168) without affecting rotation of the hose reel (116).

The gearbox (155) drives an impeller (307) that rotates within the pump body (168) to urge incoming fluid from the fluid inlet (304) toward a fluid outlet (306). The fluid outlet (306) is disposed between the fluid inlet (304) and the impeller (307) and is an arcuate aperture extending along a portion of the cylindrical surface of the bore (302).

A rotating collar (308) is rotatably coupled to and encircles at least a portion of the length of the outer surface (300) of the pump body (168) and completely surrounds the fluid outlet (306). The rotating collar forms a cavity (310) along the circumference of the encircled portion of the pump body (168) and has a collar outlet (312) in fluid communication with an outlet arm (166) further in fluid communication with the hose-reel coupling (146).

The rotating collar (308) further forms a substantially fluid-tight seal with the pump body (168) by a pair of O-rings (314, 316) disposed along either side of the cavity (310). The rotating collar (308) is held in place by a retainer ring (318) on one side and a shoulder (320) formed on the pump body (168) on the other side. Alternatively, an additional retainer ring could be provided in place of the shoulder (320).

Thus, the fluid inlet coupling is accessible proximate the outer surface of one of the side walls while the motor pump assembly and rotating collar (308) are fully enclosed within the hose reel (116) while the motor pump assembly, other than the rotating collar (308) and outlet arm (166), maintains a fixed orientation (i.e., is not rotatable) relative to the frame.

The hose reel (114) thus surrounds the motor pump assembly (120), while the hose-reel coupling (146) extends through the aperture (144) of the cylinder (116) and can be coupled to a hose (102) to be reeled on the hose reel (114). It will be appreciated that by enclosing the motor pump assembly (120) within the hose reel (114), the motor pump assembly (120) is substantially shielded from external contamination, such as dirt, debris and liquid.

In use, a user rotates the hose reel (114) until a desired length of hose (102) has been unreeled therefrom. During and following such rotation, the rotating collar (308) rotates about the pump body (168) such that the cavity (310) maintains fluid communication between the fluid outlet (306) and the collar outlet (312). Thus, regardless of the position of the hose reel, fluid communication between the pump's fluid outlet (306) and the hose (102) is maintained.

Upon a user activating the motor, the motor drives the gearbox which in turn drives the pump impeller, pressurizing water provided from the fluid inlet (304) and expelling the pressurized water from the hose (102). If the motor is not activated, the impeller is stationary and unpressurized fluid passes from the fluid inlet (304) to the hose.

Figure 9:
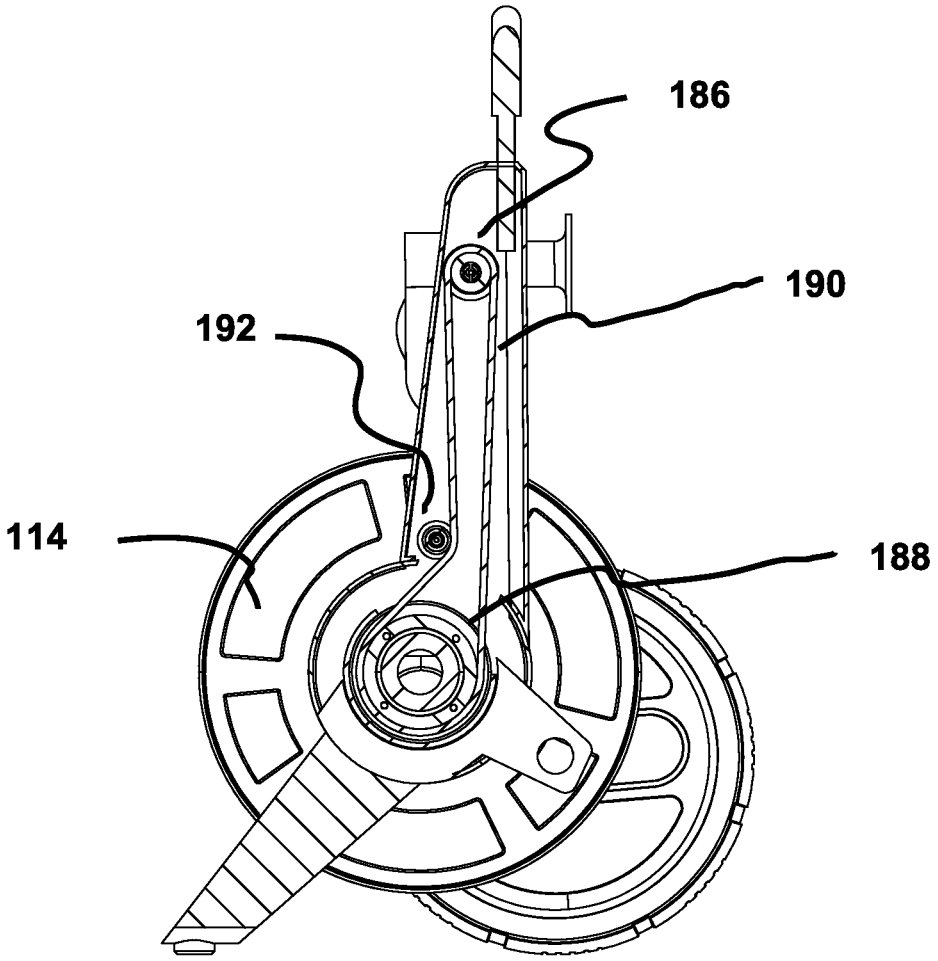
FIG. 9 is a right side cross-sectional view of the pressure washer taken along the line C-C shown in FIG. 13.

Referring now to FIG. 9, with the hose reel (114) disposed sufficiently low in the frame, the crank (136) may be mounted at a more comfortable height and coupled to the hose reel (114) to turn the hose reel (114) about the hubs (160, 168). The crank (136) may be coupled to the hose reel (114) by a pulley apparatus comprising a crank pulley (186) coaxial with the crank (136), a drum pulley (188) coaxial with the hose reel (144) and a belt (190) coupling the crank pulley (186) to the drum pulley (188). The belt (190) may be a flexible or non-flexible belt or chain. Given the weight of the hose, the crank pulley (186) may have a substantially lower radius than the hose pulley (188) to allow a user to turn the crank pulley (186) without significant physical exertion. Provided that the side wall is sufficiently narrow relative to the size of the hose pulley (188), a belt guide (192) may be provided to guide the belt away from edges or corners of the interior of the side wall (108), preventing friction which may cause damage to the belt.

Figure 10:
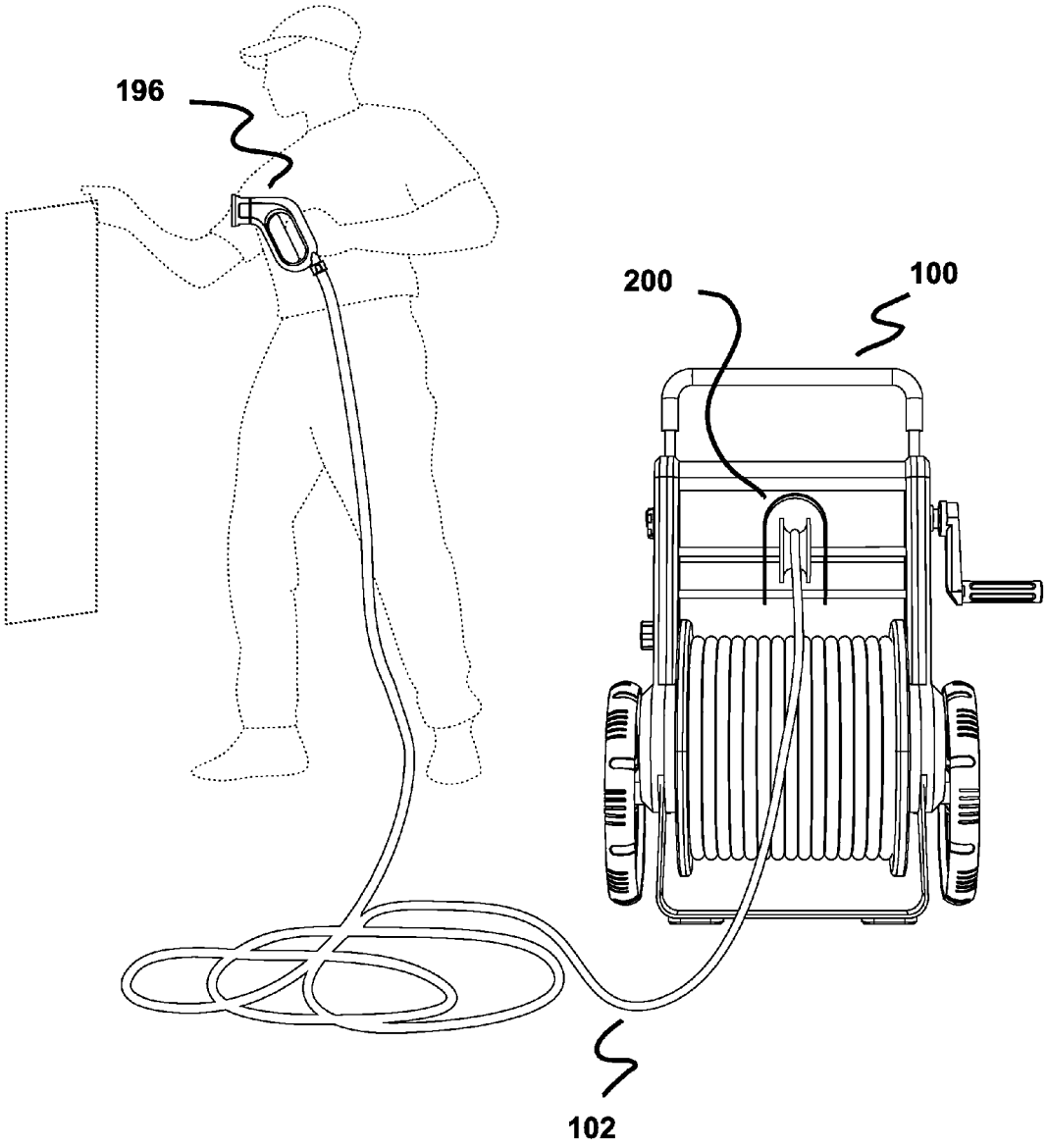
FIG. 10 is an exemplary view of the pressure washer in use.
Figure 11:
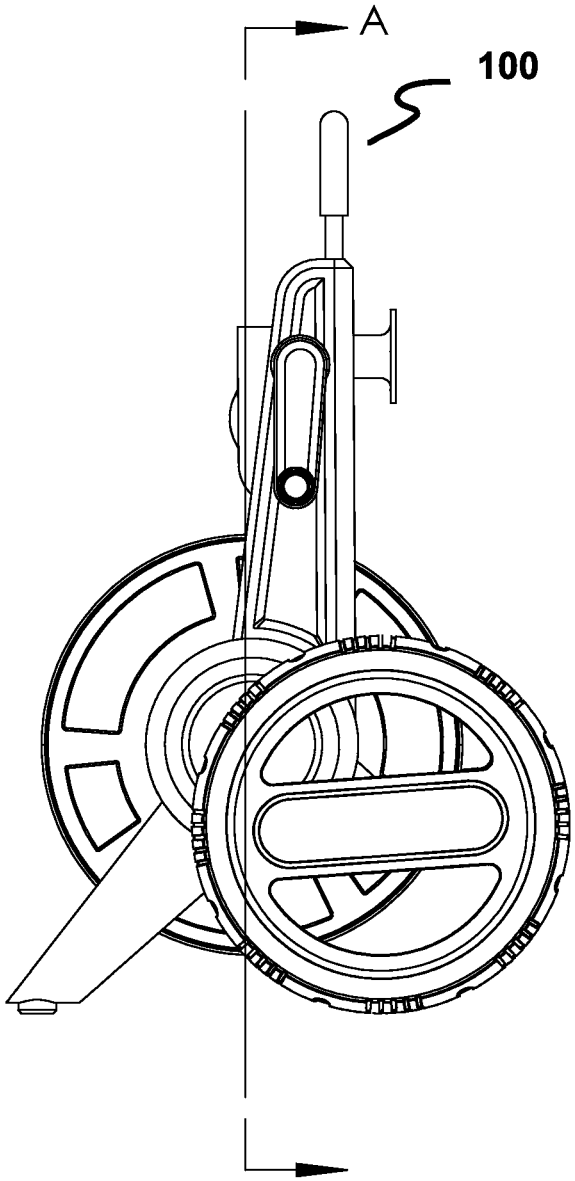
FIG. 11 is a right side view of the pressure washer.
Figure 12:
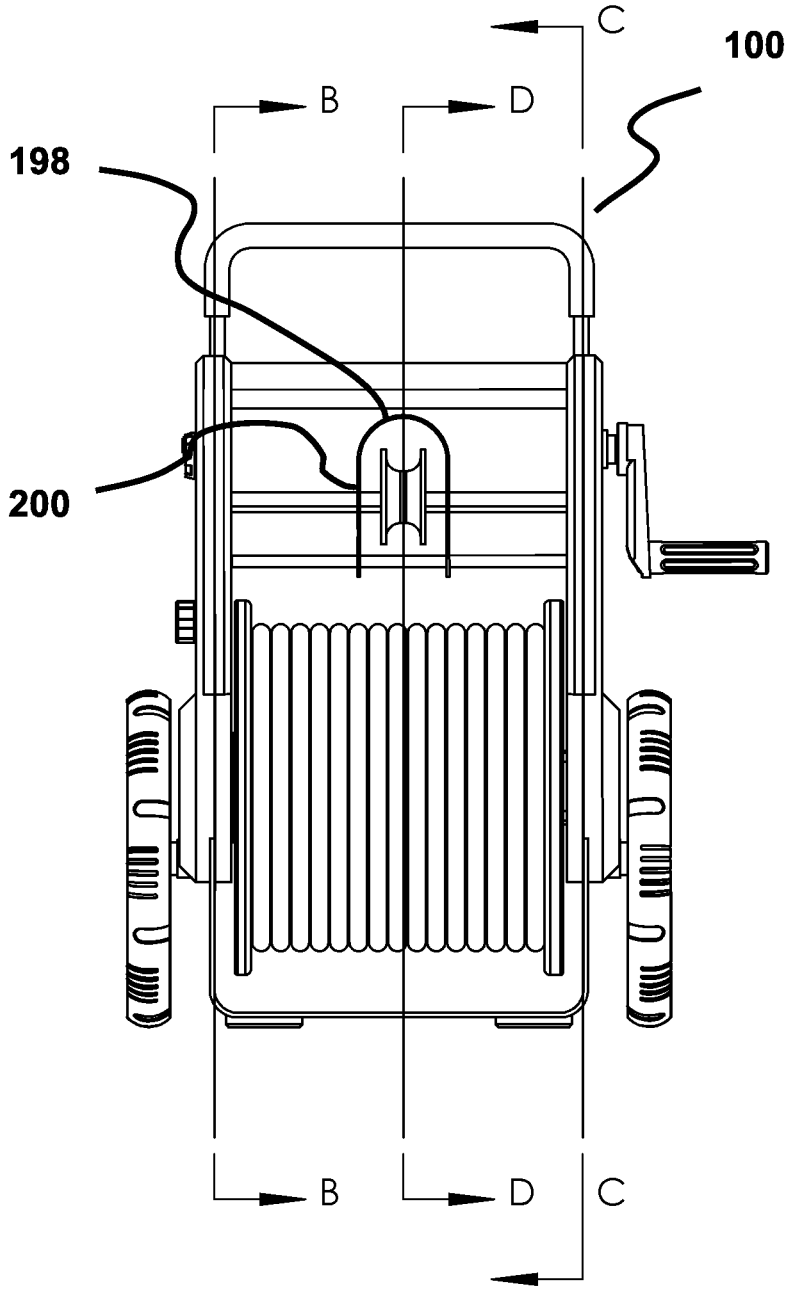
FIG. 12 is a front view of the pressure washer.

Referring to FIGS. 1, 2 and 10, a hose (102) may be coupled to the hose-reel coupling (146) at one end and has a second free end (194). A spray gun (196) or other accessory may be coupled to the free end (194). Prior to such coupling, the hose (102) may be threaded through a guideway (198) of the fairlead (200), seen in FIG. 12. As will be appreciated, the fairlead (200) moves laterally, left to right and right to left, to distribute the hose (102) evenly along the hose reel (114). The movement of the fairlead (200) may occur as a result of the rigidity of the hose urging it to one side or the other while being reeled, or could be operated manually by a user. Alternatively, the fairlead may be driven by the belt (190) operated by the crank (136), a pulley driven by the belt (190), or directly by the crank (136).

A motor pump switch (202) may be disposed upon a side wall (106) and may be electrically coupled to the motor pump assembly (120) to turn the motor (154) on or off. Preferably, the pressure washer (100) is operable regardless of whether the motor (154) is on or off, such that the pressure washer outputs fluid at an unassisted pressure when the motor (154) is off or at a higher pressure when the motor (154) is on. The switch (202) may be located at a height comfortable for a user to reach without bending over.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

We claim:

1. A fluid pump having a rotary fluid outlet for use within a rotating hose reel of a pressure washer, the fluid pump comprising:

a pump body having a cylindrical outer surface and an inner cylindrical bore;

a fluid inlet disposed at a first end of said bore, said fluid inlet permitting fluid to be provided to said fluid pump;

a fluid outlet, said fluid outlet being an arcuate aperture extending along a portion of a surface of said bore and said outer surface permitting fluid communication therethrough;

an impeller having an impeller surface and a set of radially extending vanes, said impeller disposed adjacent a second end of said bore such that said fluid outlet is disposed between said fluid inlet and said impeller surface, said impeller operable to pressurize said provided fluid and expel said pressurized fluid toward said inner cylindrical bore;

a collar encircling at least a portion of the length of said outer surface and completely surrounding said fluid outlet, said collar rotatably coupled to said pump body for enabling rotation of said collar circumferentially about said pump body, and said collar shaped to define a cavity and a collar outlet, said cavity extending circumferentially along the cylindrical outer surface and maintaining fluid communication between said collar outlet and said fluid outlet and;

a hose-reel coupling rotationally fixed, at a first end, to the collar, and, at a second end, adapted for connection to a garden hose and fixed proximal said second end to the hose reel, said hose-reel coupling in fluid communication with said collar outlet, said hose-reel coupling extending between said first and second ends through an aperture of said hose reel, said pump body being fully enclosed within a bore of said hose reel for enabling rotation of said hose reel freely about said pump body.

2. The fluid pump of claim 1, wherein said collar is held in place along said outer surface by a shoulder formed in said outer surface on one side and a retaining ring on another side.

3. The fluid pump of claim 1, wherein a pair of O-rings seals said collar to said outer surface.

4. A pressure assisted washer comprising:

a hose reel comprising a cylinder having a central bore and opposing circular side walls at ends of said bore, said hose reel being rotatable about a central axis, said cylinder having an aperture therethrough; and a motor pump assembly comprising a motor and a pump, said motor pump assembly having opposing side hubs for freely resting thereupon said hose heel for rotation of said hose reel about said central axis:

a pump body having a cylindrical outer surface and an inner cylindrical bore;

a fluid inlet disposed at a first end of said bore, said fluid inlet permitting fluid to be provided to said pump;

a fluid outlet, said fluid outlet being an arcuate aperture extending along a portion of a surface of said bore and said outer surface permitting fluid communication therethrough;

an impeller having an impeller surface and a set of radially extending vanes, said impeller disposed adjacent a second end of said bore such that said fluid outlet is disposed between said fluid inlet and said impeller surface, said impeller operable when driven by the motor to pressurize said provided fluid and expel said pressurized fluid toward said inner cylindrical bore;

a collar encircling at least a portion of the length of said outer surface and completely surrounding said fluid outlet, said collar rotatably coupled to said pump body for enabling rotation of said collar circumferentially about said pump body, and said collar shaped to define a cavity and a collar outlet, said cavity extending circumferentially along the cylindrical outer surface and maintaining fluid communication between said collar outlet and said fluid outlet and;

a hose-reel coupling rotationally fixed, at a first end, to the collar, and, at a second end, adapted for connection to a garden hose and fixed proximal said second end to the hose reel, said hose-reel coupling in fluid communication with said collar outlet, said hose-reel coupling extending between said first and second ends through the aperture of said hose reel, said pump body being fully enclosed within said bore of said hose reel for enabling rotation of said hose reel freely about said pump body; and a frame comprising two side walls joined by said motor pump assembly and permitting access to said fluid inlet for receiving fluid.

5. The pressure washer of claim 4, wherein said hose reel is disposed substantially low to the ground when said pressure washer is not in transport.

6. The pressure washer of claim 5, wherein the pressure assisted washer further comprises a pair of coaxial wheels disposed on opposing sides of said frame.

7. The pressure washer of claim 5, wherein one of said two side walls comprises a crank coupled to said hose reel, said crank being rotatable to rotate said hose reel.

8. The pressure washer of claim 7, wherein said crank is coupled to said hose reel by a belt coupling a crank pulley, said crank pulley coaxial with said crank, and a drum pulley, said drum pulley coaxial with said hose reel.

9. The pressure washer of claim 4, wherein said two side walls are further joined by a lower crossbar, said pressure washer resting upon said lower crossbar when not being transported.

10. The pressure washer of claim 9, wherein said lower crossbar has a substantially flat upper surface.

11. The pressure washer of claim 4, wherein said two side walls are further jointed by an upper crossbar, said upper crossbar being grippable by a user to transport said pressure washer.

12. The pressure washer of claim 10, wherein said two side walls are further joined by a cable reel panel disposed between said hose reel and said upper crossbar, said cable reel panel having a cable reel disposed along a surface thereof for reeling an electrical cord.

* * * * *